US012025128B2

(12) United States Patent
Schofield et al.

(10) Patent No.: US 12,025,128 B2
(45) Date of Patent: Jul. 2, 2024

(54) SCROLL PUMP WITH A PLURALITY OF BELLOWS SEALING A PLURALITY OF ADJUSTMENT MEMBERS

(71) Applicant: Edwards Limited, Burgess Hill (GB)

(72) Inventors: Nigel Paul Schofield, Burgess Hill (GB); Alan Ernest Kinnaird Holbrook, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 8 days.

(21) Appl. No.: 17/999,327

(22) PCT Filed: May 20, 2021

(86) PCT No.: PCT/GB2021/051226
§ 371 (c)(1),
(2) Date: Nov. 18, 2022

(87) PCT Pub. No.: WO2021/234395
PCT Pub. Date: Nov. 25, 2021

(65) Prior Publication Data

US 2023/0184251 A1 Jun. 15, 2023

(30) Foreign Application Priority Data

May 21, 2020 (GB) ..... 2007563

(51) Int. Cl.
*F04C 18/02* (2006.01)
*F01C 19/00* (2006.01)
*F04C 27/00* (2006.01)

(52) U.S. Cl.
CPC ..... *F04C 18/0215* (2013.01); *F01C 19/005* (2013.01); *F04C 27/002* (2013.01); *F04C 27/005* (2013.01); *F04C 2240/50* (2013.01)

(58) Field of Classification Search
CPC .. F04C 18/0215; F04C 27/002; F04C 27/005; F04C 2240/50; F01C 19/005
See application file for complete search history.

(56) References Cited

U.S. PATENT DOCUMENTS 5,759,020 A 6/1998 Shaffer
6,050,793 A 4/2000 Barthod et al.
(Continued)

FOREIGN PATENT DOCUMENTS

CN 104405618 A 3/2015
CN 204327494 U 5/2015
(Continued)

OTHER PUBLICATIONS

Foreign Patent Publication and Machine Translation for JP 2003-286974 A, Inventor: Tsukasa et al.; Title: Scroll Fluid Machine; Published Oct. 10, 2003. (Year: 2003).*
(Continued)

*Primary Examiner* — Mary Davis
(74) *Attorney, Agent, or Firm* — Theodore M. Magee; Westman, Champlin & Koehler, P.A.

(57) ABSTRACT

A scroll vacuum pump has an axially extending drive shaft with an eccentric shaft portion, such that rotation of the drive shaft imparts an orbiting motion to an orbiting scroll relative to a fixed scroll. An axial adjustment mechanism has a plurality of adjustment members angularly spaced around the drive shaft and extending through the pump housing towards the orbiting scroll, the plurality of adjustment members each being configured to provide an independently adjustable axial position of the orbiting scroll. A plurality of sealing means isolate the plurality of adjustment members from a pump chamber, the plurality of sealing means extending around each of the plurality of adjustment members and comprising at least one flexible portion such that one end of
(Continued)

the sealing means may orbit relative to a fixed other end of the sealing means.

17 Claims, 3 Drawing Sheets

(56) References Cited

U.S. PATENT DOCUMENTS

| | | | | |
|---|---|---|---|---|
| 7,442,016 | B2 * | 10/2008 | Dovey | F04C 18/0215 418/55.4 |
| 9,605,674 | B2 * | 3/2017 | Forni | F04C 18/0215 |

FOREIGN PATENT DOCUMENTS

| | | | |
|---|---|---|---|
| GB | 1165435 | | 10/1969 |
| GB | 2514639 | A | 12/2014 |
| JP | H11280673 | A | 10/1999 |
| WO | 2017220961 | A1 | 12/2017 |

OTHER PUBLICATIONS

Foreign Patent Publication and Machine Translation for JP 2003-161272; Inventor: Tsukasa et al.; Title: Scroll Type Pump; Published Jun. 6, 2003. (Year: 2003).*

British Examination Report dated Sep. 25, 2020 and Search Report dated Sep. 24, 2020 for corresponding British Application No. GB2007563.6, 5 pages.

PCT Notification of Transmittal of the International Search Report and the Written Opinion of the International Searching Authority, or the Declaration and PCT Search Report dated Aug. 31, 2021 for corresponding PCT application Serial No. PCT/GB2021/051226, 7 pages.

PCT Written Opinion of the International Searching Authority dated Aug. 31, 2021 for corresponding PCT application Serial No. PCT/GB2021/051226, 9 pages.

Invitation to Pay Additional Fee and, Where Applicable, Protest Fee dated Jul. 9, 2021 and Communication Relating to the Results of the Partial International Search and Provisional Opinion Accompanying the Partial Search Result dated Jul. 9, 2021 for corresponding PCT application Serial No. PCT/GB2021/051226, 11 pages.

British Examination Report dated Jul. 23, 2021 and Search Report dated Jul. 22, 2021 for corresponding British Application Serial No. GB2007563.6, 5 pages.

* cited by examiner

SCROLL PUMP WITH A PLURALITY OF BELLOWS SEALING A PLURALITY OF ADJUSTMENT MEMBERS

CROSS-REFERENCE OF RELATED APPLICATION

This application is a Section 371 National Stage Application of International Application No. PCT/GB2021/051226, filed May 20, 2021, and published as WO 2021/234395A1 on Nov. 25, 2021, the content of which is hereby incorporated by reference in its entirety and which claims priority of British Application No. 2007563.6, filed May 21, 2020.

FIELD

The field of the invention relates to a scroll pump, particular examples relate to a vacuum scroll pump.

BACKGROUND

A scroll pump is formed of two interleaving scrolls mounted such that rotation of a drive shaft imparts an orbital motion to one of the scrolls with respect to the other, thereby trapping and pumping or compressing pockets of fluid between the scrolls. In some cases, one of the scrolls is fixed, while the other is mounted on a drive shaft with an eccentric cam such that it orbits eccentrically without rotating.

Conventionally scroll pumps have been provided with tip seals mounted on the ends of the helical scroll walls and configured to touch the opposing scroll plate to provide sealing between the scrolls allowing the pocket of fluid to be effectively pushed from the inlet to the outlet. Although tip seals provide effective sealing, they degrade over time, need replacement and generate dust which can contaminate a clean environment.

WO 2017/220961 describes a vacuum scroll pump where the problem with tip seals is addressed using axial thrust bearings which have an axial adjustment mechanism that allows the axial clearances to be adjusted and reduced to low levels. In this way axial clearances are provided that are small enough to provide effective pumping without the need for tip seals.

Although such axial thrust bearings address many of the problems that arise with tip seals they provide their own challenges, as the bearings require lubricant and this may leak into the pumping area and itself cause contamination.

It would be desirable to provide a scroll pump with effective sealing and pumping capabilities and low contamination.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a scroll vacuum pump comprising: an orbiting scroll; and a fixed scroll; a pump housing enclosing a pump chamber of said scroll vacuum pump; an axially extending drive shaft having an eccentric shaft portion, said orbiting scroll being mounted on said eccentric shaft portion such that rotation of said drive shaft imparts an orbiting motion to said orbiting scroll relative to said fixed scroll; an axial adjustment mechanism for adjusting an axial position of said orbiting scroll and thereby a distance between said fixed scroll and said orbiting scroll, said axial adjustment mechanism comprising a plurality of adjustment members angularly spaced around said drive shaft and extending through said pump housing towards said orbiting scroll, said plurality of adjustment members each being configured to provide an independently adjustable axial position of said orbiting scroll; and a plurality of sealing means for isolating said plurality of adjustment members from said pump chamber, said plurality of sealing means extending around each of said plurality of adjustment members and comprising at least one flexible portion such that one end of said sealing means may orbit relative to a fixed other end of said sealing means.

The inventors of the present invention recognised that a plurality of adjustment members extending through the pump housing and controlling an axial position of an orbiting scroll at a plurality of different points allows not only the gap between the scrolls to be adjusted but also problems with tilt and swash associated with the orbiting scroll to be addressed, at least to some extent. However, such members extend into the pump housing at an interface that allows axial movement of the members. Furthermore, the axial positioning of the orbiting scroll by these members requires some contact between one or more orbiting and non-orbiting surfaces. These two issues can lead to leakage into and/or contamination of the pump chamber within the pump housing. The inventors of the present invention recognised that both issues could be addressed by isolating each of the adjustment members from the pump chamber with a plurality of sealing means that extend around each of the plurality of adjustment members. These sealing means are formed of at least one flexible portion that allows one end of the sealing means to orbit with respect to a fixed portion at the other end. In this way effective sealing between an orbiting surface and a fixed surface can be provided. Furthermore, by providing a plurality of sealing means around each individual adjustment member as opposed to providing one sealing means around them all, allows the width of such sealing means to be reduced, thereby reducing the amount of material required and providing a more compact sealing means. This reduction in width may allow the length of the sealing means to be correspondingly reduced which in turn allows the length of the pump to be reduced. This leads not only to a more compact pump but one that is less susceptible to differential thermal expansion of the different parts. Lower differential thermal expansion helps maintain precision control of the location of the orbiting scroll, allowing tip seals to be dispensed with while providing an effective sealing means.

In some embodiments, said plurality of sealing means each comprises bellows.

Although the sealing means may be formed in different ways provided that at least a portion of the sealing means is flexible, bellows are an effective sealing means which also act to inhibit rotation of the orbiting scroll. With bellows, the flexibility to allow the orbital motion increases with the length of the bellows and inversely with the width. Thus, providing individual narrower bellows correspondent to each adjustment member, allows them to be shorter while still providing similar flexibility and similar fatigue life to wider, longer bellows. Thus, bellows that enclose individual adjustment members with their reduced diameter can have correspondingly reduced lengths.

The bellows may be formed of a number of materials including metals and polymers. The polymers may include a heat resistant polymer such as PTFE (polytetrafluoroethylene).

In some embodiments, said plurality of sealing means are each attached at one end to said pump housing and at another end to at least one surface orbiting with said orbiting scroll.

The sealing means may be configured to seal between the pump housing and a surface that orbits with the orbiting scroll. In this way the sealing members are fixed to surfaces such that there is no relative motion between the sealing means and the surfaces, the relative motion all being within the flexible portion of the sealing means. This reduces wear at the connecting surfaces, increases seal lifetime and provides a hermetic seal with no sliding surfaces to generate contamination.

In some embodiments, said axial adjustment mechanism comprises an axial thrust bearing arrangement, said axial thrust bearing arrangement comprising:

a plurality of ball bearings mounted between said orbiting scroll and at least one thrust surface; and said plurality of adjustment members, said plurality of adjustment members each being configured to independently adjust an axial position of said at least one thrust surface.

Although the axial adjustment mechanism may have a number of forms, for example it may comprise three mini cranks for mounting the orbiting scroll, in some cases it comprises an axial thrust bearing which arrangement is particularly effective at providing an accurate axial positioning of the different locations of the orbiting scroll controlled by the adjustment members. An axial thrust bearing has ball bearings mounted between a thrust surface and the orbiting scroll, which ball bearings are the interface for the relative movement between the surfaces and are lubricated to reduce friction and wear. The sealing means provides an effective way of isolating the lubricant from the pump chamber defined by the pump housing.

In some embodiments, said at least one thrust surface is mounted on an end of said plurality of adjustment members.

The axial adjustment mechanism may comprise an axial thrust bearing with the thrust surface being on the end of the axial adjustment member and abutting against a ball bearing which in turn abuts against the orbiting scroll. In this regard, the ball bearing may abut against a thrust surface on the orbiting scroll. Adjustment of the axial position of the axial member adjusts the position of the thrust surface and thus, via the ball bearing the axial position of the orbiting scroll.

In some embodiments, said at least one thrust surface is mounted on an end of said plurality of adjustment members.

In some cases the axial thrust bearing may be a single axial thrust bearing with a single thrust surface that is mounted on each of the plurality of the adjustment members.

In some embodiments said at least one thrust surface comprises a ring-shaped surface facing said orbiting scroll and extending around a central axis of said orbiting scroll.

Where the thrust surface is a single thrust surface mounted on a plurality of adjustable members then in some embodiments it may be a ring shaped surface that faces the orbiting scroll and extends around a central axis of the orbiting scroll. The ball bearings themselves are arranged in a ring-type arrangement and are pushed against the orbiting scroll by the ring shaped thrust surface. The ring shaped surface has a width that is sufficient to allow the ball bearings to describe a circular motion as the orbiting scroll orbits while still remaining within the ring shaped thrust surface.

In some embodiments, said at least one thrust surface is mounted such that a radially central point of said at least one thrust surface is between 30% and 80% of a radius of said orbiting scroll.

Although the thrust surface may be mounted in a number of different positions, in some cases it may be mounted between 30 and 80% of a radius of an orbital scroll. In this regard, it may be advantageous for it to be towards the outer edge, perhaps between 60 and 80% of the radius where the independent adjustment has an increased effect on tilt and swash of the orbiting scroll and whereby additional axial support is provided such that warping of the orbiting scroll is reduced.

In some embodiments, said scroll vacuum pump further comprises at least one receptacle mounted on said orbiting scroll, said at least one receptacle enclosing said ball bearings and comprising said at least one surface, said plurality of adjustment members each extending through a corresponding aperture in said at least one surface, said other end of said plurality of sealing members sealing to said at least one surface around said plurality of apertures.

As noted previously, the sealing means may attach between a surface that orbits with the scroll and the surface of the pump housing and this attachment is such that there are no sliding surfaces allowing the seal to be hermetic and the flexibility that allows the motion to be within the flexible portion of the sealing means. One way of doing this may be to provide a receptacle that surrounds the ball bearings and thrust surface and has an aperture through which the adjustment member extends.

In some embodiments, said receptacle has a ring form and is configured and mounted to enclose said ring thrust surface, said at least one surface comprising a single ring surface and comprising a plurality of apertures at locations corresponding to said plurality of adjustment members.

Where there is a single thrust bearing with a ring form, then the receptacle too may have a ring form and be configured to enclose the ring thrust surface. In this case, there are a plurality of apertures in the surface of the ring shaped receptacle that faces away from the orbiting scroll.

In some embodiments, said axial thrust bearing arrangement comprises a retainer comprising an inner ring and an outer ring extending perpendicularly around the central axis of said orbital scroll and configured to retain said ball bearings between said rings.

Where the axial thrust bearing is a single ring shaped bearing then there may be retaining means for retaining the ball bearings within this ring formation. The retaining means may be mounted on the orbiting scroll and orbit with the orbiting scroll.

In other embodiments, said axial thrust bearing arrangement comprises a plurality of thrust surfaces corresponding to said plurality of adjustment members.

In some cases rather than having a single axial thrust bearing arrangement there may be a plurality of thrust surfaces corresponding to the plurality of adjustment members. This may have the advantage of smaller thrust surfaces which reduces the costs and weight of the pump. Thrust surfaces can be costly having stringent requirements. Furthermore, where the portion of the bearing mounted to orbit with the orbiting scroll has a reduced size and weight, this has a beneficial effect on the orbiting mass and the vibrations it generates.

In some embodiments, said plurality of thrust surfaces are substantially circular surfaces.

In some embodiments, said plurality of thrust surfaces are pivotally mounted on a member contacting a central portion of each substantially circular surface.

Where there are individual thrust surfaces corresponding to each adjustment member, then their form may be a circular form allowing the ball bearings to proceed in a circular motion as the orbiting scroll rotates. In some embodiments the thrust surfaces may be mounted on a central member, such as a central adjustment pin that allows pivoting, making the surfaces self-levelling and providing good ball contact and potentially a longer bearing life.

In some embodiments, said axial thrust bearing arrangement comprises a plurality of modules corresponding to said plurality of adjustment members, said plurality of modules each comprising a plurality of ball bearings mounted within a restraint, said restraint being configured to hold said ball bearings within said module while allowing each of said ball bearings to describe a circular path corresponding to the orbiting motion of the orbiting scroll.

Where the axial thrust bearing arrangement comprises a plurality of individual axial thrust surfaces mounted on the axial adjustment members then the ball bearings may be mounted within a plurality of individual modules corresponding to each adjustment member, thereby reducing the size, weight and perhaps cost of the bearing arrangement.

In some embodiments, said restraint comprises at least one cage comprising a plurality of circular recesses for holding said plurality of ball bearings, said circular recesses having a larger diameter than said ball bearings such that said ball bearings can describe said circular path.

The ball bearings may be held in position by a restraint which in some cases comprises one or more cages, in some embodiments two cages each of which comprise a plurality of circular recesses that hold the ball bearings within the module while allowing them to describe the circular path required for the relative orbital motion.

In some embodiments, said scroll vacuum pump comprises a plurality of said receptacles corresponding to said plurality of adjustment members, each of said plurality of receptacles comprising said at least one surface and an aperture in said at least one surface.

Where there are a plurality of axial thrust bearings then there may be a receptacle mounted around each one and having an aperture in a surface through which the adjustment member extends.

Again such an arrangement reduces the size and mass of the receptacle which orbits with the scroll thereby reducing the bearing loads and the vibrations generated.

In some embodiments, said plurality of adjustment members comprises three adjustment members.

In order to provide accurate axial adjustment of the axial distance between the orbiting scroll and fixed scroll and also provide some control of tilt and swash of the orbiting scroll more than one axially adjustment member is required and in many cases there are three adjustment members. Three adjustment members provide the required degrees of freedom to provide good and effective tilt and swash control without unduly increasing the number of parts required. Thus, in some embodiments there are exactly three adjustment members. It is appropriate for them to be substantially equally angularly spaced around the central axis, and in some embodiments they are between 100° and 140° apart in some cases substantially 120° apart.

In some embodiments, said fixed scroll provides a central aperture through which said drive shaft extends.

Embodiments are particularly appropriate to scroll pumps where the inlet vacuum space is on the orbital scroll side of the pump. The inlet of the vacuum pump connects to the chamber being evacuated and it is here where it is particularly important to reduce contamination. Thus, where there is contact between moving and static surfaces, being able to isolate these contacting surfaces from the vacuum inlet space enclosed by the pump housing allows contamination either from the relative movement or from lubricant associated with the relatively moving surfaces to be inhibited and provides for a low contamination scroll pump.

A second aspect provides a scroll pump comprising:

an orbiting scroll; and a fixed scroll;

a pump housing enclosing a pump chamber;

- an axially extending drive shaft having an eccentric shaft portion, said orbiting scroll being mounted on said eccentric shaft portion such that rotation of said drive shaft imparts an orbiting motion to said orbiting scroll relative to said fixed scroll;
- an axial thrust bearing arrangement comprising:
  - a plurality of ball bearings modules each comprising a plurality of ball bearings, said plurality of ball bearing modules being mounted between said orbiting scroll and a plurality of thrust surfaces;
  - an adjustment mechanism for adjusting an axial position of said plurality of thrust surfaces and thereby a distance between said fixed scroll and said orbiting scroll, said adjustment mechanism comprising:
  - a plurality of adjustment members angularly spaced around said drive shaft and each being configured for independent adjustment of an axial position of a corresponding one of said plurality of thrust surfaces.

Embodiments are able to provide effective axial adjustment of the orbiting scroll using a plurality of axial adjustment members such that the distance between the orbiting scroll and the fixed scroll can be accurately controlled. An axial thrust bearing arrangement that has individual bearing modules and thrust surfaces associated with them and which correspond to the plurality of axial adjustment members allows for reduced orbiting mass, facilitates sealing of the bearing covers, and provides for bearings, covers and thrust surfaces of reduced size and therefore costs.

In some embodiments, said plurality of thrust surfaces are substantially circular and are each mounted on a corresponding end of said plurality of adjustment members.

In some embodiments, said plurality of thrust surfaces are pivotally mounted on a member contacting a central portion of said substantially circular surface.

In some embodiments, said plurality of ball bearings within each of said modules are mounted within a restraint, said restraint being configured to hold said ball bearings within said module while allowing each of said ball bearings to describe a circular path corresponding to the orbiting motion of the orbiting scroll.

In some embodiments, said restraint comprises at least one cage comprising a plurality of circular recesses for holding said plurality of ball bearings, said circular recesses having a larger diameter than said ball bearings such that said ball bearings can describe said circular path.

In some embodiments, said restraint comprises two cages, a thickness of each of said two cages being between 60 and 99.9% of a radius of said ball bearings.

Where there are two cages then their thickness should be slightly less than the radius of the ball bearings. In some cases between 60 and 99.9% of a radius of the ball bearing allowing the ball bearing to extend beyond the cage and contact the surfaces while still being held in position.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

Embodiments provide a scroll pump, in some cases a scroll vacuum pump with a precision controlled axial thrust bearing to set tip clearance and thereby dispense with the need for tip seals. The thrust bearing is in the inlet vacuum space and there may be mini bellow seals around each axial thrust bearing arrangement to isolate the lubricant from the inlet vacuum space.

Embodiments provide a set of three metal or polymer bellows to seal the axial thrust bearing and its adjustment system, from the inlet space of the vacuum pump.

In embodiments, the thrust bearing is mounted on the back of the orbiting scroll. A sealed cover or receptacle is arranged over this bearing. The places at which the adjustment members or screws pass through the cover and connect to the bearing are then sealed with a bellows which allows the cover to move in an orbiting motion with the scroll, while the part of the bearing held by the adjustment screws remains stationary.

In embodiments there are three adjustment screws and three bellows. The axial thrust bearing can be split into three separate thrust bearings, each individually sealed, or can be a single ring with three adjustment members or screws.

Using three bellows instead of a single large diameter bellows means that the bellows length can be shorter which makes the pump shorter and more importantly, less susceptible to differential thermal expansion of the parts and therefore maintains improved precision control of the thrust bearing and the scroll-to-scroll axial clearance.

Where the thrust bearings are individual modules, the individual non-orbiting thrust plates that are mounted on the adjustment members may be supported on a central adjusting pin allow pivoting, and making them self-levelling thereby ensuring good ball contact and potentially better life.

This arrangement provides a reduced orbiting mass, reducing pump vibration. Furthermore, sealing the bearing covers is potentially easier with this modular arrangement and the bearing parts and the covers are smaller, which reduces costs.

Figure 1:
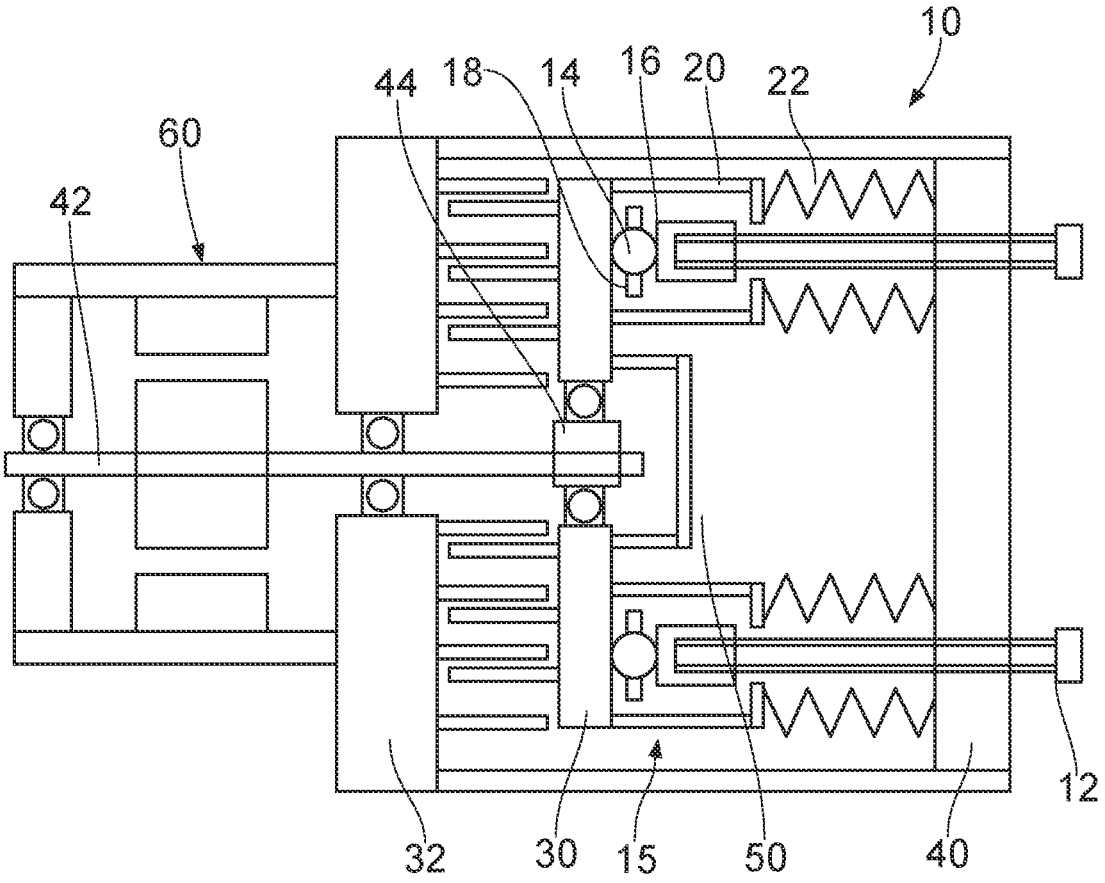
FIG. 1 shows a scroll pump according to one embodiment.

FIG. 1 shows a scroll pump 10 according to one embodiment. Scroll pump 10 comprises an orbiting scroll 30 mounted on an eccentric cam portion 44 of a rotatable drive shaft 42. The drive shaft 42 is driven by a motor 60 and during use rotation of the drive shaft 42 imparts an orbiting motion to the orbiting scroll 30 relative to a fixed scroll 32. The orbiting motion pumps fluid along a fluid flow path between a pump inlet located near the edge of the scrolls towards a pump outlet near the centre.

In this arrangement, the fixed scroll 32 comprises an opening through which the drive shaft 42 extends. The motor 60 driving the drive shaft is located on the fixed scroll side of the pump. An inlet vacuum region is located towards the right hand side of the figure away from the motor and bearings. A lower vacuum, or atmospheric, region is located towards the outlet side of the pump towards the motor.

The drive shaft 42 is sealed from the inlet vacuum space defined by pump housing 40 by cover 50. As the drive shaft 42, drive motor 60 and associated bearings for mounting the drive shaft 42 are located on the exhaust side of the scroll pump, contamination from any lubricants associated with these parts are to some extent isolated from the fluid being pumped simply by the direction of flow of that fluid.

However, in this embodiment there are axial thrust bearings 15, which themselves contain lubricant within the inlet vacuum region. These provide control of the axial position of the orbiting scroll and thus, of the gap between the scrolls. If contamination by lubricant is to be inhibited these axial thrust bearings 15 should themselves be isolated to some degree from this inlet vacuum region.

The axial thrust bearings 15 comprise axial adjustment members 12 which extend out through a wall of pump housing 40 allowing access to the adjustment members such that their axial length and thus, the clearances between the scrolls can be adjusted. These axial adjustment members 12 abut against a thrust surface 16 which in this embodiment has a ring shape extending around a central axis of the orbiting scroll 30. The thrust surface 16 is pushed by the adjustment member against the ball bearings 14 of the axial thrust bearing 15 which in turn push against orbiting scroll 30. Thus, by adjusting the lengths of adjustment members 12 the clearance distance between the scroll plates can be controlled.

In this embodiment there are three adjustment members 12 that can each be independently adjusted allowing not only the clearance distance to be altered but also any swash or lean associated with the orbiting scroll to be reduced. The ball bearings 14 are held in position by retaining rings 18 which extend on either side of ball bearings 14. The ball bearings follow a circular path as the orbiting scroll orbits. There is a further thrust surface mounted on the plate of the orbiting scroll that the ball bearings abut against. In this way, any wear on the orbiting scroll plate by the ball bearings movement is reduced.

In order to inhibit any leakage of lubricant from the axial thrust bearing into the chamber defined by pump housing 40 and fixed scroll 32 the axial thrust bearing 15 and adjustment members 12 are enclosed within sealing means 20, 22. These sealing means comprise a ring like receptacle or cover 20 having apertures corresponding to the multiple adjustment members 12. These receptacles are fixedly mounted on the back of the orbiting scroll plate. The sealing means further comprises bellows 22 configured to extend from the receptacles 20 and to seal to the receptacle surface around the apertures. The bellows 22 extend from the surface of the receptacle to the end wall of pump housing 40 enclosing the adjustment members 12. The bellows seal to the inner surface of the end wall 40 around an aperture that the adjustment members pass through. In this way, the sealing means 20, 22 seal to surfaces in a fixed way, the relative movement between the orbiting scroll and the end wall of the pump housing being absorbed by the flexibility of the walls of the bellows 22.

Although, in this embodiment the flexible portion of the sealing means comprises bellows 22, in other embodiments other flexible arrangements may be used to provide the flexible portion of the sealing means. An advantage of the bellows arrangement is that it inhibits rotational movement of the orbiting scroll.

By providing individual sealing means to surround each of the individual adjustment members of the axial thrust bearing arrangement, the diameter of the sealing means and also the length, which is related to diameter, can be significantly smaller than were the whole axial thrust bearing arrangement to be enclosed in a single sealing means. This allows for a smaller pump to be produced and thereby reduces thermal differentials within the pump allowing for greater precision in the axial control of the scroll positions.

Figure 2:
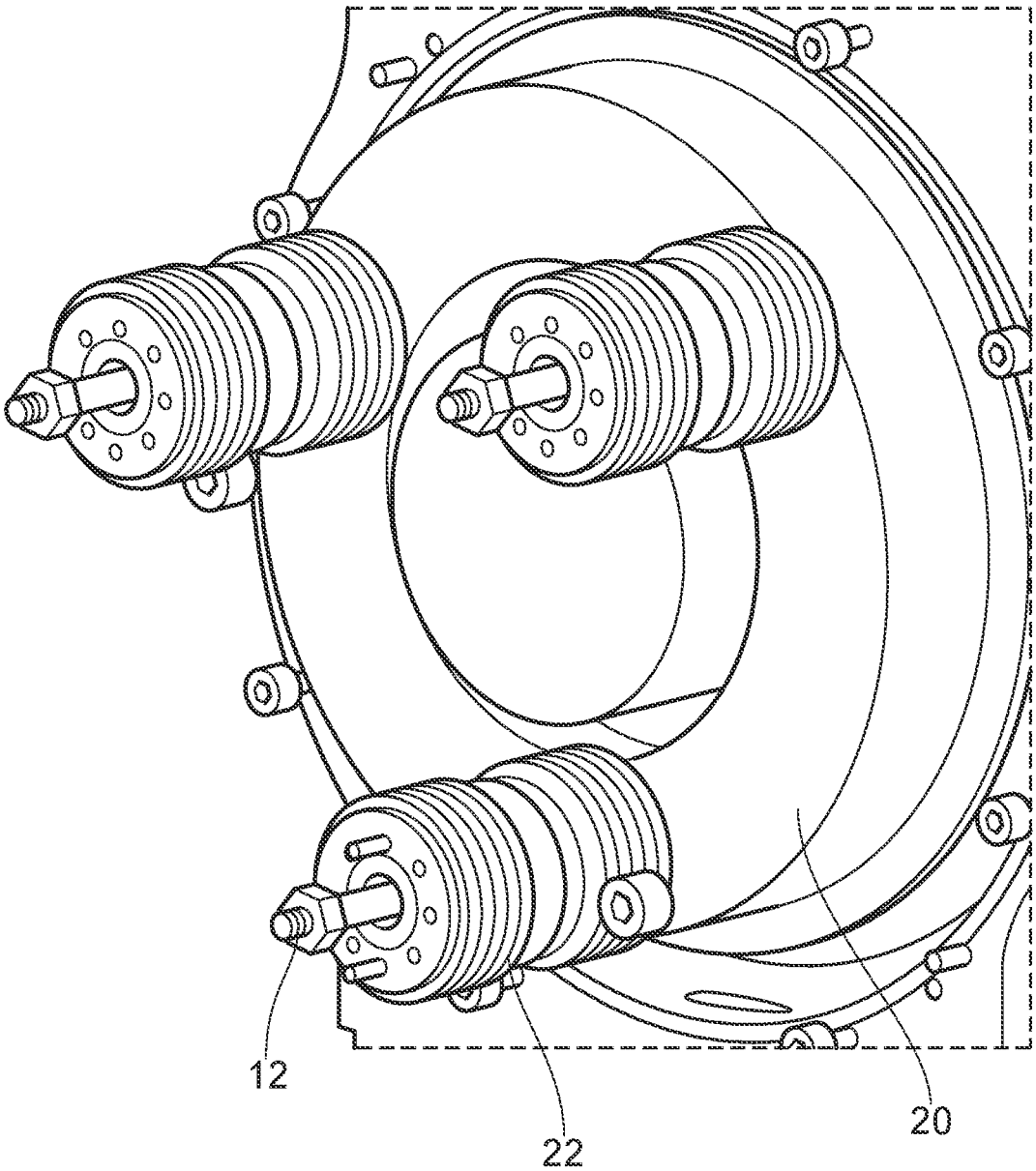
FIG. 2 shows an end view of the sealing and adjustment members of an embodiment.

FIG. 2 shows an end view of the scroll pump of FIG. 1 without the housing 40. In this embodiment, there is a single axial thrust bearing having a ring type shape and a corresponding ring shaped receptacle 20. There are three adjustment members 12 extending through apertures in the surface of the receptacle 20 that faces away from the orbiting scroll. Each of the adjustment members 12 are enclosed by sealing means 22 in the form of bellows which seal to the surface of receptacle 20 around the apertures through which the adjustment members 12 extend and extend up to the housing 40 of the pump (not shown) and seal to this housing. In this way, the adjustment members 12 and the thrust bearings within receptacle 20 are isolated from the vacuum inlet space within pump housing. Sealing members 22 are flexible and this allows the portion contacting receptacle 20 to perform an orbital motion with this receptacle, while the other end of the sealing means 22 is attached to the housing 40 and does not move. In some embodiments, the orbiting motion results in the ball bearings following a circular path of a diameter of between 1 and 9 mm, while the diameter of each of the bellows is between 30 and 150 mm, and the length is between 30 and 160 mm.

Figure 3:
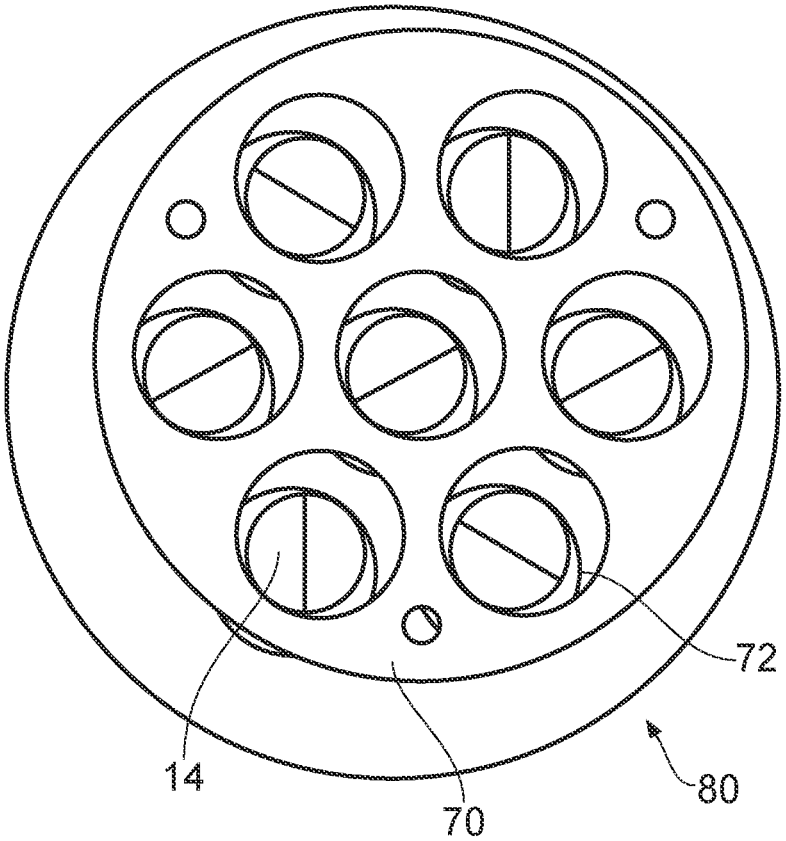
FIG. 3 shows a bearing module according to an embodiment.

FIG. 3 shows a bearing module 80 of an alternative embodiment where rather than having a single ring-shaped axial thrust bearing, there are a plurality of individual axial thrust bearings corresponding to the plurality of adjustment members. Each adjustment member has a thrust surface on an end face which contacts the ball bearings 14 within individual bearing modules 80, which ball bearings in turn contact a thrust surface on the orbiting scroll.

In this embodiment there are seven ball bearings 14, although there may be a different number, for example six if there is no central ball bearing, located within a cage 70. The cage 70 has recesses 72 within which the balls can move. The recesses 72 are configured to be large enough to accommodate the balls describing the circular path that allows them to follow the orbiting motion of the scroll.

Figure 4:
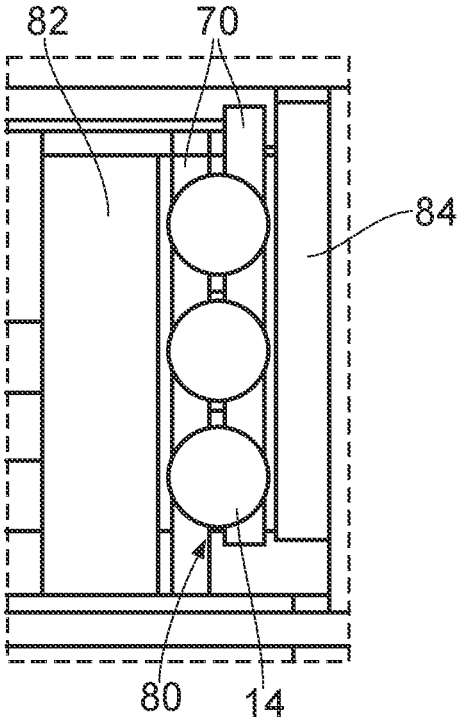
FIG. 4 shows a side view of the bearing module of FIG. 3.

FIG. 4 shows a side view of the bearing module 80 along with the thrust plate 82 mounted on the adjustment member. This thrust plate 82 is supported on a central pin (not shown) which allows pivoting of this plate making the thrust plate 82 self-levelling and ensuring good ball contact and potentially a longer life for the bearing. There is a further thrust plate 84 connected to the orbiting scroll and configured to orbit with the scroll. The bearing module 80 comprises two cages 70, one mounted to thrust plate 82 on the adjustment member and the other to thrust plate 84 on the orbiting scroll. Between the two cages 70 are ball bearings 14. The cages 70 are configured such that they have a thickness that is less than the radius of the balls such that the balls 14 contact the thrust plate. The thicknesses may only be slightly less, in some embodiments they are between 70 and 99.9% of the radius of the balls 14. For example, the ball bearings may have a diameter of 8 mm, a radius of 4 mm and the cage may have a thickness of 3.99 mm, giving a cage to radius ratio of 99.75%.

Providing individual bearing modules 80 rather than a ring bearing allows the thrust plates to be smaller and thus, the orbiting mass to be lower which reduces the pump mass and vibrations. It also potentially allows sealing of the bearing covers to be easier. Furthermore, all of the bearing parts, the covers and the thrust surfaces will be smaller which reduces costs.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A scroll vacuum pump comprising:

an orbiting scroll;

a fixed scroll;

a pump housing enclosing a pump chamber of said scroll vacuum pump;

an axially extending drive shaft having an eccentric shaft portion, said orbiting scroll being mounted on said eccentric shaft portion such that rotation of said drive shaft imparts an orbiting motion to said orbiting scroll relative to said fixed scroll;

an axial adjustment mechanism for adjusting an axial position of said orbiting scroll and thereby a distance between said fixed scroll and said orbiting scroll, said axial adjustment mechanism comprising a plurality of adjustment members angularly spaced around said drive shaft and extending through said pump housing towards said orbiting scroll, said plurality of adjustment members each being configured to provide an independently adjustable axial position of said orbiting scroll; and a plurality of sealing means for isolating said plurality of adjustment members from said pump chamber, said plurality of sealing means extending around each of said plurality of adjustment members and comprising at least one flexible portion such that one end of said sealing means may orbit relative to a fixed other end of said sealing means.

2. The scroll vacuum pump according to claim 1, wherein said plurality of sealing means each comprises bellows.

3. The scroll pump according to claim 2, wherein said bellows are formed of at least one of a metal and a polymer.

4. The scroll vacuum pump according to claim 1, wherein said plurality of sealing means are each attached at one end to said pump housing and at an other end to at least one surface orbiting with said orbiting scroll.

5. The scroll vacuum pump according to claim 1, wherein said axial adjustment mechanism comprises an axial thrust bearing arrangement, said axial thrust bearing arrangement comprising:

a plurality of ball bearings mounted between said orbiting scroll and at least one thrust surface; and said plurality of adjustment members each being configured to independently adjust an axial position of said at least one thrust surface.

6. The scroll vacuum pump according to claim 5, wherein said at least one thrust surface is mounted such that a radially central point of said at least one thrust surface is between 30% and 80% of a radius of said orbiting scroll.

7. The scroll vacuum pump according to claim 5, wherein said at least one thrust surface comprises a ring-shaped surface facing said orbiting scroll and extending around a central axis of said orbiting scroll.

8. The scroll vacuum pump according to claim 5, wherein said plurality of sealing means are each attached at one end to said pump housing and at another end to at least one orbiting surface orbiting with said orbiting scroll, said scroll vacuum pump further comprising at least one receptacle mounted on said orbiting scroll, said at least one receptacle enclosing said ball bearings and comprising said at least one orbiting surface, said plurality of adjustment members each extending through a corresponding aperture in said at least one orbiting surface, said other end of said plurality of sealing members sealing to said at least one orbiting surface around said corresponding aperture.

9. The scroll vacuum pump according to claim 8, wherein said at least one thrust surface comprises a ring-shaped surface facing said orbiting scroll and extending around a central axis of said orbiting scroll and wherein said at least one receptacle has a ring form and is configured and mounted to enclose said ring-shaped thrust surface, said at least one orbiting surface comprising a single ring surface and comprising a plurality of apertures at locations corresponding to said plurality of adjustment members.

10. The scroll vacuum pump according to claim 5, wherein said at least one thrust surface comprises a plurality of thrust surfaces corresponding to said plurality of adjustment members.

11. The scroll vacuum pump according to claim 10, wherein said axial thrust bearing arrangement comprises a plurality of modules corresponding to said plurality of adjustment members, said plurality of modules each comprising a plurality of ball bearings mounted within a restraint, said restraint being configured to hold said ball bearings within said module while allowing each of said ball bearings to follow a circular path corresponding to the orbiting motion of the orbiting scroll.

12. The scroll vacuum pump according to claim 11, wherein said restraint comprises at least one cage comprising a plurality of circular recesses for holding said plurality of ball bearings, said circular recesses having a larger diameter than said ball bearings such that said ball bearings can follow said circular path.

13. The scroll vacuum pump according to claim 10, said scroll vacuum pump comprising a plurality of receptacles corresponding to said plurality of adjustment members, each of said plurality of receptacles comprising an orbiting surface and an aperture in said orbiting surface.

14. The scroll vacuum pump according to claim 10, wherein said plurality of thrust surfaces are substantially circular surfaces.

15. The scroll vacuum pump according to claim 5, wherein said at least one thrust surface is mounted on an end of said plurality of adjustment members.

16. The scroll vacuum pump according to claim 1, wherein said plurality of adjustment members comprises three adjustment members.

17. The scroll vacuum pump according to claim 1, said fixed scroll comprising a central aperture through which said drive shaft extends.

* * * * *